United States Patent [19]

Anderson et al.

[11] Patent Number: 4,631,451

[45] Date of Patent: Dec. 23, 1986

[54] BLAST GAP IGNITION SYSTEM

[75] Inventors: Richard W. Anderson, Ann Arbor; Joseph R. Asik, Bloomfield Hills; Richard C. Ronzi, Birmingham; Aladar O. Simko, Dearborn Heights, all of Mich.

[73] Assignee: Ford Motor Company, Dearborn, Mich.

[21] Appl. No.: 748,137

[22] Filed: Jun. 24, 1985

Related U.S. Application Data

[63] Continuation-in-part of Ser. No. 553,210, Nov. 18, 1983, abandoned.

[51] Int. Cl.[4] ..... H05B 37/02; H05B 39/04; H05B 41/36

[52] U.S. Cl. ..... 315/209 R; 315/58; 315/171; 313/130; 313/139; 123/620

[58] Field of Search ..... 315/58, 59, 209 R, 209 T, 315/171; 313/130, 131 R, 132, 139, 141, 131; 123/620

[56] References Cited

U.S. PATENT DOCUMENTS

| | | | |
|---|---|---|---|
| 2,415,138 | 2/1947 | Kasarjian | 315/59 X |
| 2,483,357 | 9/1949 | Winholm | 315/59 X |
| 2,831,138 | 4/1958 | Teasel | 313/130 |
| 3,037,140 | 5/1962 | Schurecht | 313/130 X |
| 3,202,859 | 8/1965 | Knaggs | 313/130 |
| 3,394,285 | 7/1968 | Lindsay | 315/58 |
| 3,538,372 | 11/1970 | Terao | 315/59 X |
| 3,683,232 | 8/1972 | Baur | 315/58 |
| 4,087,719 | 5/1978 | Pratt, Jr. | 315/45 |
| 4,092,558 | 5/1978 | Yamada | 313/131 R |
| 4,326,493 | 4/1982 | Merrick | 123/620 X |
| 4,462,380 | 7/1984 | Asik | 123/620 |
| 4,497,306 | 2/1985 | Hamai et al. | 123/620 |

FOREIGN PATENT DOCUMENTS

| | | | |
|---|---|---|---|
| 846638 | 8/1952 | Fed. Rep. of Germany | 313/130 |
| 1307681 | 9/1962 | France | 315/58 |
| 54-13844 | 2/1979 | Japan | 313/130 |

*Primary Examiner*—Saxfield Chatmon
*Attorney, Agent, or Firm*—Peter Abolins; Robert D. Sanborn

[57] ABSTRACT

A spark plug for an ignition system has a ring gap between two electrodes. A first electrode has a ring shape defining a central opening. A second electrode is positioned within the central opening of the first electrode. An insulating material is positioned between the first and second electrodes so as to provide a surface for a spark path between the first and second electrodes. The insulating material is spaced from the electrode so as to provide therebetween an air gap for increased sparking.

7 Claims, 12 Drawing Figures

BLAST GAP IGNITION SYSTEM

This application is a continuation-in-part, of application Ser. No. 553,210, filed Nov. 18, 1983 now abandoned.

BACKGROUND OF THE INVENTION

1. Field of the Invention

This invention relates to spark plugs for use in internal combustion engines.

2. Prior Art

U.S. Pat. No. 3,202,859 issued to Knaggs teaches a spark plug in which a central electrode extends above the end of the spark plug. The elongated central electrode is surrounded by an insulator which is, in turn, surrounded by the ground electrode. The ground electrode is an annular shell which is in direct contact with the insulator. There is no air gap in this construction and the spark generated travels along the surface of the insulator from the central electrode to the ground electrode.

U.S. Pat. No. 4,087,719 issued to Pratt, Jr. teaches a spark plug with an insulator between an annular ground electrode and a central live electrode. The central electrode has a sparking surface which is not covered by the insulator. The annular ground electrode is attached to the spark plug body. The annular electrode and the central insulator are not in direct contact with any air gap.

U.S. Pat. No. 3,683,232 issued to Baur teaches a spark plug cap wherein a capacitance is connected between a live electrode lead and ground. The extra capacitance functions to increase the intensity of the spark generated at an air gap between the live electrode and the ground electrode.

Further improved ignition is desired in engines using a lean air to fuel ratio. In particular, it would be desirable to produce in high swirl engines a stable discharge with both greatly increased arc length and ionization volume without significantly higher required breakdown voltage, thus leading to improved ignitability. These are some of the problems this invention overcomes.

SUMMARY OF THE INVENTION

In accordance with this invention, a spark plug has a ring air gap and surface spark path between a first electrode and a second electrode. The first electrode has a ring shape and defines a central opening. The second electrode is positioned within the central opening of the first electrode. A ceramic insulating material is positioned between the first and second electrodes so as to provide a surface for a spark path between the first and second electrodes. The insulating material is spaced from the first electrode ring so as to provide therebetween an air gap. As a result, the spark path follows the insulating material surface until the air gap to the first electrode is reached where the spark leaves the surface of the insulating material.

This invention provides improved sparking which is especially advantageous for igniting high swirl or high in-cylinder flow mixtures. The advantage occurs because the spark, once ignited anywhere along the ring electrode, can move along the ring electrode and ceramic surface to a region of low flow velocity on the sheltered side of the spark plug opposite from the side impinged by gas flow. This helps to maintain the flame kernel attached to the ring electrode, leads to improved ignitability and reduces cycle by cycle combustion pressure variation. The initial flame kernel has a more favorable region to develop on the lee side of the ceramic tip of the plug than on the high velocity side, since the lower velocities present on the lee side reduce the convective heat loss from the developing nascent flame kernel. This allows more rapid flame kernel development and a more consistant ignition location for improved combustion stability. Including an air gap spark path, in addition to the surfaces spark path, facilitates spark movement and insures sparking even if the surface becomes fouled with carbon.

This invention further includes the combination of a supplementary spark energy (SSE) ignition system and the ring gap spark plug. This combination has superior ignitability and combustion stability. The ring gap plug has rotational symmetry around its rotational axis so that even with changing direction of combustion flow in the cylinder the spark gap and the final location of the spark discharge is independent of spark plug rotational orientation. As described, the design of the ring gap plug allows the spark discharge and the nascent flame kernel origin to move to the down wing side of the plug while still remaining attached to the ceramic surface of the ring gap plug. However, when the spark discharge terminates, the flame kernel origin can become detached from the surface of the plug and wander in a random fashion, subject to eddies and vortices much smaller than the size of the combustion chamber. When this happens, increased cycle by cycle combustion variability will result, since the effective origin of the flame front is different from cycle to cycle. The hot gases associated with the burnt mixture behind the flame front tend to spiral into the center of the combustion chamber by centrifugal force, since their specific density is less than that of the unburnt mixture.

Use of a long duration SSE ignition system allows the flame kernel origin to remain on the down wind side of the ring gap plug (in the recirculation zone) attached to the surface of the ring gap plug for a much longer time and a much larger number of crank angle degrees, thus promoting combustion stability and ignitability. For example, 9 ms is the spark duration of a typical SSE ignition system at 1000 rpm, while 1.5 ms is a typical spark duration for a conventional inductive discharge ignition system.

Consider an engine at 1000 rpm with a swirl ratio of 3 (swirl rpm/engine rpm), a 80 mm bore, a spark plug at a 20 mm radius, and a combustion duration of 50° of crank angle. The combustion time is 8.3 ms. At the plug location, the swirl velocity is 6000 mm/s or 6 mm/ms. Thus, if the flame kernel becomes detached from the spark plug, it can move 6 mm in one ms. This amount of movement would give rise to a large change in the timing of the occurrence of peak cylinder pressure arising from the large change in the effective origin of the combustion flame. That is, the time of occurrence of the peak cylinder pressure after the initiation of spark depends upon the relative position of the spark within the combustible mixture contained within the cylinder. A spark located at the center of the cylinder provides the most rapid occurrence of peak cylinder pressure.

In summary, the combination of SSE ignition system and ring gap plug promotes improved combustion stability and ignitability by creating a region of low fluid motion and turbulence on the down wind side of the plug and by forcing the effective flame front origin to be more nearly fixed, through the longer spark duration, during the crucial early development states of the combustion flame.

DETAILED DESCRIPTION OF THE INVENTION

Figure 1:
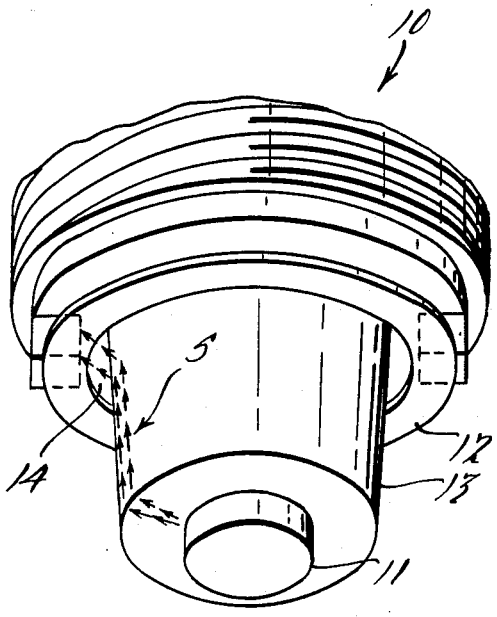
FIG. 1 is a perspective view of the tip of a spark plug in accordance with an embodiment of this invention.

Referring to FIG. 1, a spark plug 10 includes a central electrode 11 and an annular ring electrode 12. Concentric about electrode 11 is a ceramic insulator 13 with a generally tubular shape. Electrode 11 is generally elongated with a right cylindrical shape having a diameter of 1 to 3 mm, typically. Insulator 13 is concentric about electrode 11 and in contact with electrode 11. Electrode 12 is formed in a ring (12 in FIG. 2A) or toroidal washer (12B in FIG. 2B) shape about insulator 13 and is spaced from insulator 13 by a ring like air gap 14 having a dimension of about 0.25 to 0.75 mm, typically. The outside diameter of the ring is about 8–12 mm, while its inside diameter is about 4–6 mm, typically.

In operation, a spark path, S, tracks the surface of insulator 13 from electrode 11 until air gap 14 is reached where the spark path jumps air gap 14 to electrode 12. As a result, most of the breakdown voltage (10–30 KV, typically) required during actual engine operation is to breakdown air gap 14 while the length of the spark can be substantially longer than air gap 14, since it includes the track over the surface of insulator 13. The length of surface tracking is about 1 to 3 mm, typically.

Figure 2A:
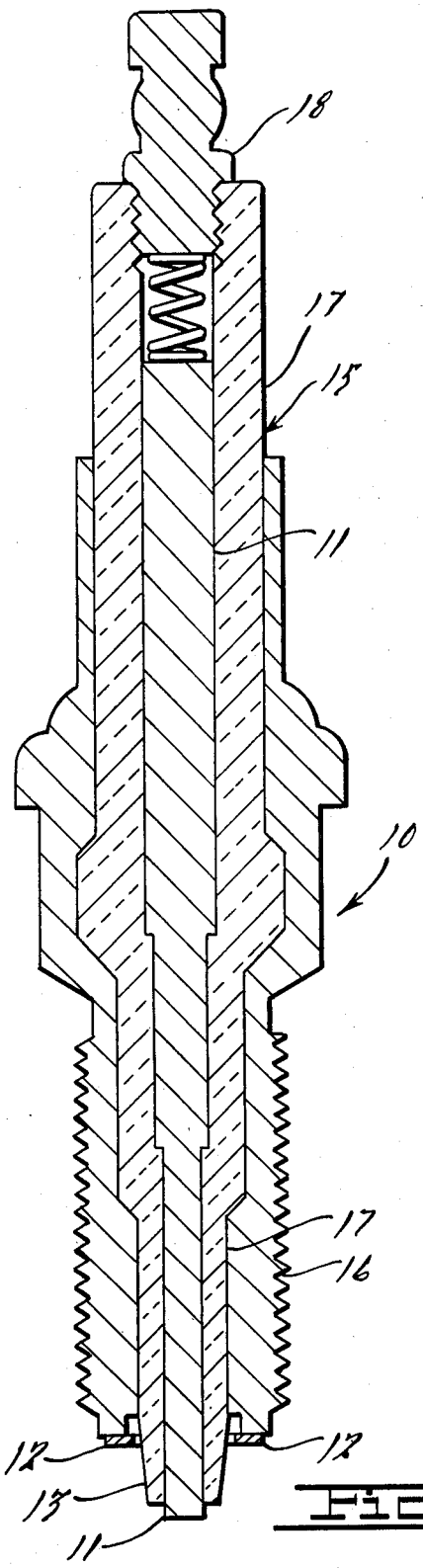
FIG. 2A is a cross section view of a spark plug in accordance with an embodiment of this invention.
Figure 2B:
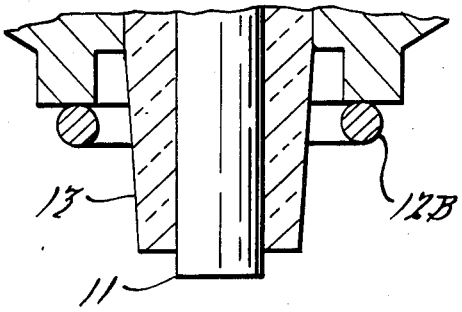
FIG. 2B is a portion of a view similar to FIG. 2A wherein one spark plug electrode is toroidal with a circular cross section.

Referring to FIG. 2A, a cross section of spark plug 10 includes an integral capacitor 15 which is formed from a conductive member 16 which is coupled to electrode 12, a dielectric member 17 and a conductive member 18 receiving spark energy coupled to spark plug 10. Conductive member 18 is electrically connected to electrode 11. Dielectric member 17 is generally tubular and extends axially along a portion of spark plug 10.

Figure 3:
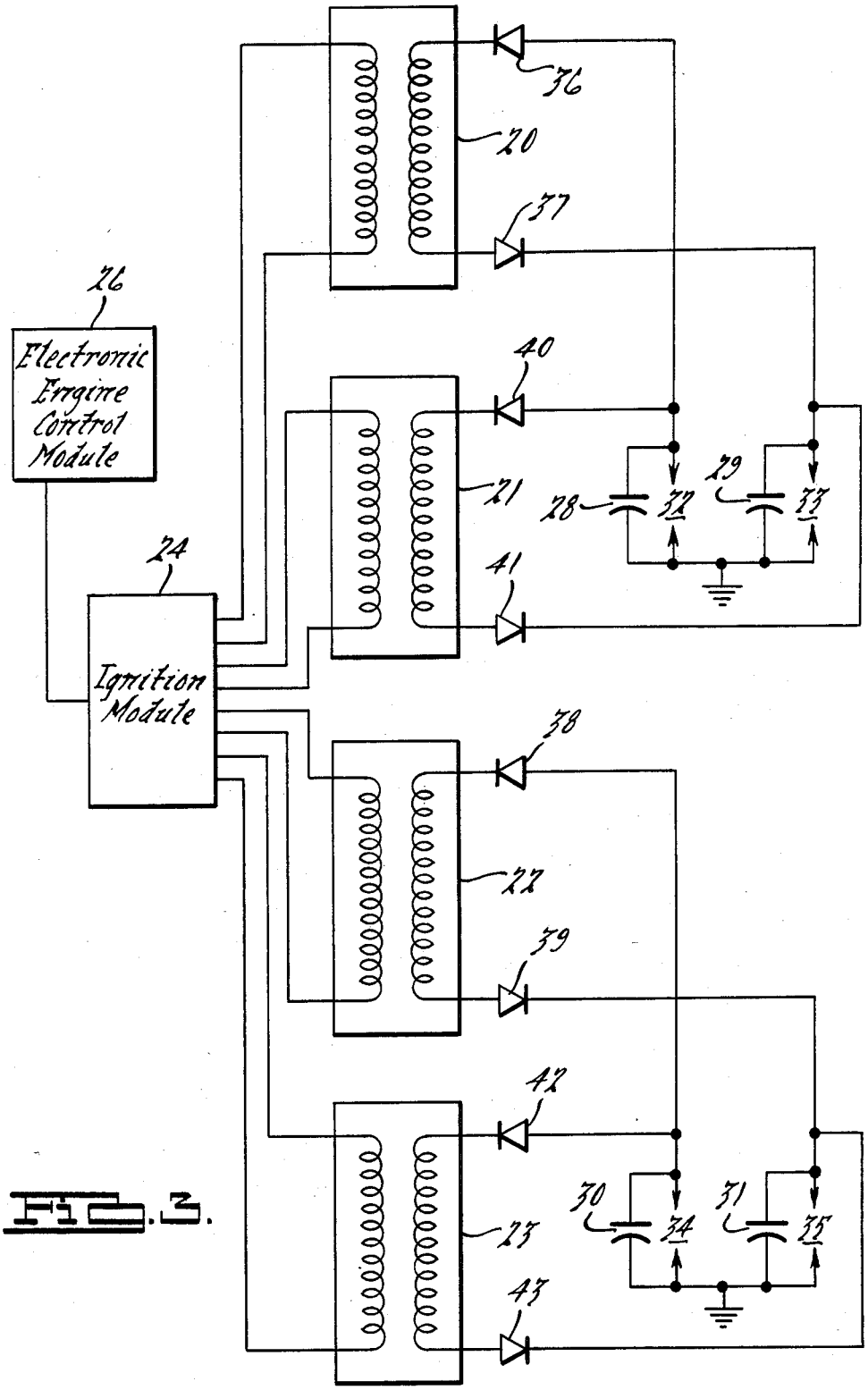
FIG. 3 is a circuit diagram suitable for connection to a spark plug in accordance with an embodiment of this invention.

In order to maintain a stable, non-extinguishable sparking arc during high in-cylinder flow conditions, the ring gap plug requires sufficient ignition energy. Further, the added plug capacitance requires extra ignition energy to satisfactorily charge up the capacitance to a spark plug breakdown voltage. FIG. 3 shows a circuit which provides sufficient ignition energy for the operation of a ring gap spark plug in accordance with an embodiment of this invention.

Referring to FIG. 3, showing a high energy four cylinder distributorless ignition system, a typical connection is shown including coils 20, 21, 22 and 23 coupled to an ignition module 24 which is controlled by an engine control computer 26. Capacitors 28, 29, 30 and 31 are shown in parallel with spark plug gaps 32, 33, 34 and 35, respectively. Coils 20 and 22 are coupled to spark plug gaps 32, 33, 34 and 35 by diodes 36, 37, 38 and 39, respectively. Coils 21 and 23 are coupled to spark plug gaps 32, 33, 34 and 35 by diodes 40, 41, 42 and 43, respectively.

In operation, by analyzing input sensor signals from the engine (not shown) and following an internal control program, the electronic engine control module determines when to energize and de-energize a pair of coils, e.g. 20 and 21. The time interval of energization is commonly called dwell and the de-energizing time is called the spark timing. Sufficient dwell time is allowed to ensure adequate stored energy in the coils. Upon de-energizing, energy is quickly transferred from each coil primary winding to the coil secondary winding, resulting in secondary current flow into each capacitor, 28 and 29, until spark gap breakdown occurs. Upon breakdown, the energy residing on the capacitors and any residual coil energy are discharged into gaps 32 and 33. One gap, e.g. 32, corresponds to an engine cylinder in the compression stroke, while the other, 33, corresponds to an engine cylinder in the exhaust stroke. The high voltage diodes 36 and 40 "OR" two negative voltage outputs into plug gap 32, while diodes 41 and 37 "OR" two positive voltage outputs into plug gap 33. The ignition module includes power transistor switches used to energize and de-energize the coil primary windings from a 14 V battery supply. Similar events occur 180° of crank angle later when the lower pair of coils 22 and 23, gaps 34 and 35, diodes 38, 39, 42 and 43, are activated by the electronic engine control module.

Advantageously, spark plug 10 has a higher plug capacitance (100–200 picofarads) versus a currently common value of about 10 picofarads. This leads to much increased peak capacitance current of 200 to 1000 amperes vs. 10–50 amperes in the initial breakdown event which occurs during the first 100 nanoseconds of spark generation. Such an intense and rapid initial breakdown generates a plasma shock wave which produces a much larger initial flame kernel, leading to a 0–10% mass fraction burn time reduction up to about 10%, and improved ignitability and combustion stability. The large circumferential ground electrode and the plug have a structure providing good durability and heat range capability.

The use of a distributorless ignition system by itself with this spark plug provides engine packaging flexibility, low generated radio frequency interference and improved reliability.

The combination of the ring gap spark plug with a distributorless system and additional capacitance in parallel with the spark gap can provide benefits such as extended lean operation with improved fuel economy, improved combustion stability resulting in better driveability, reduced radio frequency interference through elimination of the distributor, reduced complexity, improved idle quality and reduced idle fuel flow, and improved wet weather starting because of lack of condensation in distributor.

A supplementary spark energy (SSE) ignition system can generate a spark duration that is approximately constant in engine crank angle duration or duty cycle. The spark duration is defined as the length of time or number of degrees that the spark current flows through the spark plug gap. The SSE spark duration is adjusted automatically by controlling the spark duration duty cycle to a range of 20–30%. For example, for a four cylinder engine firing every 180°, this leads to a spark duration of 6–9 ms at 1000 rpm. The SSE spark duration thus decreases with increasing engine rpm. A standard production induction discharge system can generate a spark duration that is approximately fixed in time at a value of about 1.0 to 1.5 ms. A fixed spark duration leads to a duty cycle that varies inversely with engine rpm. For a four cylinder engine, a spark duration of 1.0 ms results in a duty cycle of 1.7% at 1000 rpm and 10% at 6000 rpm.

Since the ignitability of engine combustible mixtures is generally poorer at lower engine rpms, where engine loads are lighter (resulting in lower in-cylinder pressures, lower in-cylinder chemical energy densities, larger residual gas fraction, and larger cycle to cycle combustion variability). there is a need for longer spark durations with accompanying increased spark energy in the case of low engine rpm and light load conditions.

Figure 4:
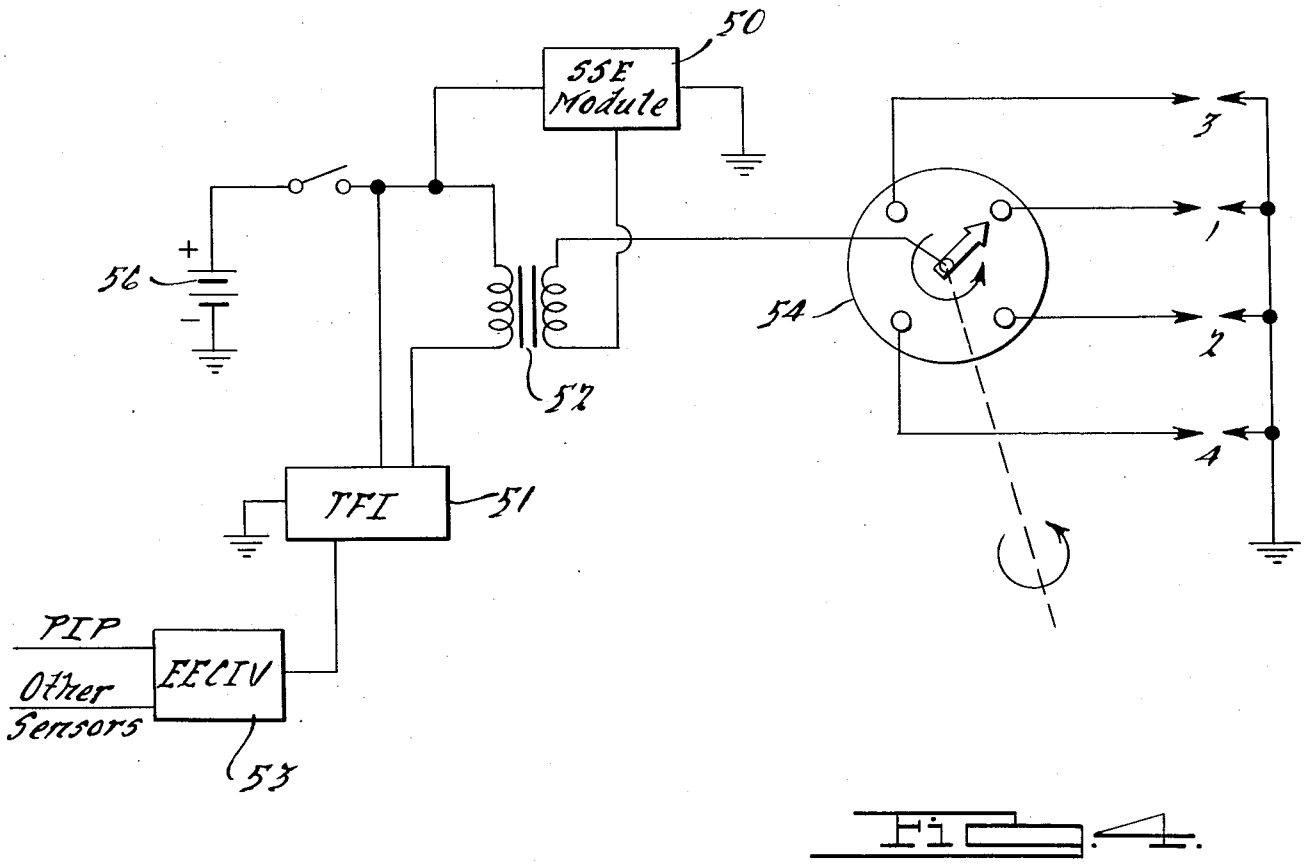
FIG. 4 is a circuit diagram of a supplemental spark energy ignition system in accordance with an embodiment of this invention.

FIG. 4 shows an overall diagram of the SSE ignition system. Internal circuitry within an SSE module 50 derives the turn-on command from the initial spark current of a TFI thick film ignition (TFI) module 51. A 12 V battery 56 supplies power for SSE module 50 and an ignition coil 52. Ignition coil 52 includes an inductive discharge ignition coil with external connection of both high voltage (HV) secondary winding leads. One HV lead is connected to the rotor of a distributor 54. The second HV lead is connected to SSE module 50. The purpose of SSE module 50 is to sustain the spark current beyond a typical spark duration of 1.0 to 1.5 ms. This is done by generating a negative 2500 V that is applied to the second HV lead, which in turn produces a current of about 25 mA which passes through the secondary winding, through distributor 54, and through spark plug number 1 in FIG. 4.

SSE module 50 is a dc to dc converter which transforms 12 V from battery 56 into a negative 2500 V. The dc to dc converter is turned on when TFI module 51 receives a spark firing command from an engine control module 53 and is turned off by an internal duty cycle control circuit. The spark firing command instructs TFI module 51 to shut off the current through the primary winding of ignition coil 52. This causes a build up of negative voltage in the secondary winding until electrical breakdown of both distributor 54 and the spark plug gaps occurs. This results in the initiation of spark current through the plug.

Flow of current from SSE module 50 through the spark plug persists as long as the dc to dc converter is on and as long as the electrical conditions at the spark plug gap and distributor 54 permit. These conditions basically require that SSE module 50 be able to maintain the required voltage drops across the rotor-distributor cap spark gap and across the spark plug gap. The rotor gap voltage drop increases as the rotor gap increases and the spark plug gap voltage drop increases as the pressure at the spark plug gap increases. If the total voltage drop required is larger than approximately 2500 V, the supplementary spark current from SSE module 50 will cease even with the converter on.

Figure 5:
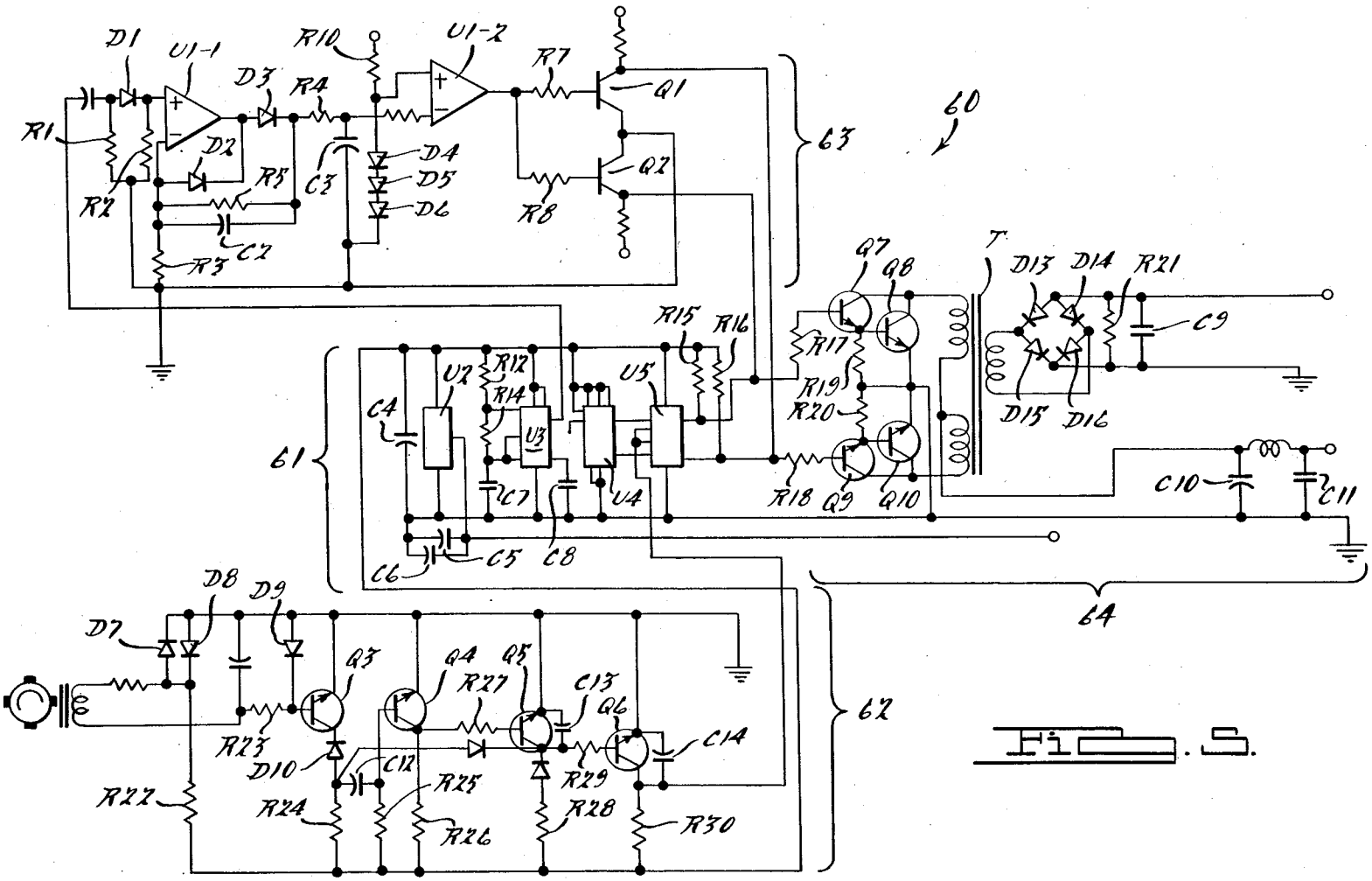
FIG. 5 is a more detailed schematic diagram of a portion of FIG. 4 including the circuitry within supplemental spark energy ignition module which has an antilatch control circuit, a power stage, a control pulse stage, and a spark duration control circuit.

The circuit diagram of an SSE ignition system 60 is shown in FIG. 5. The system consists of four major sections, a control pulse circuit 61, a spark duration control circuit 62, an antilatch control circuit 63, and a power stage 64.

The purpose of control pulse circuit 61 is to generate a 4 kHz–50% duty circuit signal that switches final power transistors Q8 and Q10 on and off in antiphase. This applies +/−12 V to a transformer T primary winding. Circuit U2 is a 5 V regulator, circuit U3 is a 555 frequency generator for timing, circuit U4 is a dual JK flipflop that generates the two antiphase signals, circuit U5 is a dual AND gate that permits control of the application of the antiphase drive signals to transistor buffers Q7 and Q9, which in turn drive the final power transistors Q8 and Q10. The output of duration control circuit 62 determines the duty cycle (on-time-/(on-time off-time)) of the converter. It permits the 4 kHz signals to be applied to transistors Q8 and Q10 only while lead C is high (Q6 off). When lead C is low, corresponding to an off state of the converter, the outputs of circuit U5 are low, resulting in no drive to power stage 64.

The purpose of spark duration control circuit 62 is to generate an approximately 30% duty cycle control signal that is applied to lead C, controlling the on and off time of the power stage. This is done by use of a type of monostable multivibrator circuit that is triggered by the spark firing command from engine control module 53. When a positive going signal is applied to the base of transistor Q3, it turns on, which turns transistor Q4 off, transistor Q5 on, and transistor Q6 off. Transistor Q4 stays off until capacitor C12 is recharged through resistor R25 and attains sufficient voltage to turn on transistor Q4. Since capacitor C12 is recharged through resistor R24 during the off time, the duty cycle determined by the charging of capacitor C12 through resistor R25 is approximately constant. Note that transistor Q5 provides a latching effect for the collector of transistor Q3 by keeping its potential at Vce(sat) Q5+0.7 V during the converter on time.

Antilatch control circuit 63 functions to disable power stage 64 from control pulse stage 61 upon power up. If this is not done, one of the two final power transistors will turn on, draw excess current, and prevent the oscillator from functioning, resulting in a latch up state and damage to the electrical components. Power stage 64 is disabled until antilatch circuit 63 senses a 4 kHz signal. Circuit U1-1 rectifies this signal, buffers it, and charges C3. Circuit U1-2 compares the voltage on capacitor C3 with a reference voltage of 2.1 V from three series diodes. If the capacitor voltage is less than 2.1 V, transistors Q1 and Q2 are turned on, which disable the drive from circuit U5 to transistors Q7 and Q9. Otherwise, with a proper 4 kHz signal, transistors Q1 and Q2 are off, permitting drive to power stage 64.

Power stage 64 consists of the two final power transistors, Q8 and Q10, and their drivers, transistors Q7 and Q9, the transformer T, the secondary HV rectifier bridge, diodes D13, D14, D15 and D16, and a parallel load of resistor R21 and capacitor C9. The bridge rectifier is in series with the secondary winding of the SSE ignition coil. When transistors Q8 and Q10 are receiving their normal 4 kHz drive, they chop the 12 V supply current to the center-tapped primary winding, which generates 2500 to 3000 V across resistor R21 and capacitor C9 and causes a current to flow through the secondary winding of the SSE coil if both the distributor gap and the spark plug gap are ionized. Each half of transformer T has a turns ratio of 3500:17, permitting a peak open circuit secondary voltage of about 5000 V. Under typical load, the output voltage is about 2500 V.

Figure 6:
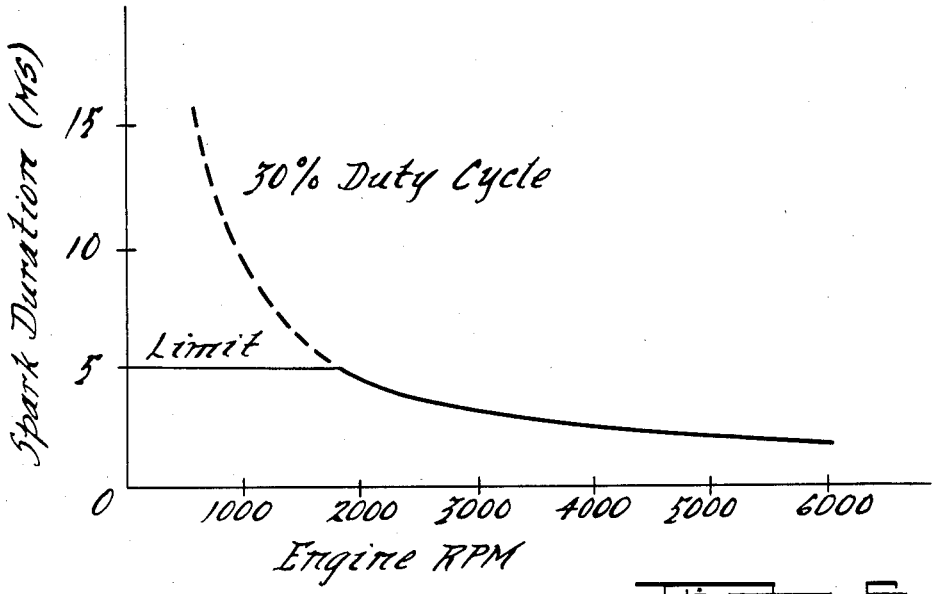
FIG. 6 is a graphical representation of spark duration versus engine rpm for a four-cylinder engine in accordance with an embodiment of this invention.
Figure 7:
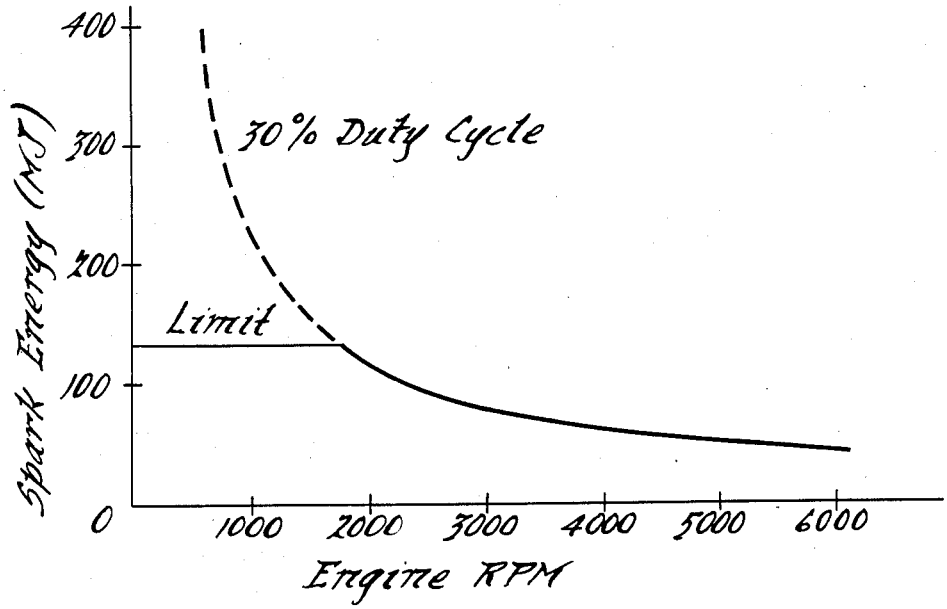
FIG. 7 is a graphical representation of spark energy versus engine rpm for a four-cylinder engine in accordance with an embodiment of this invention.

FIGS. 6 and 7 illustrate typical behavior of the spark duration and spark energy of an SSE ignition system, respectively. Two modes are possible. In the first, the SSE duty cycle is maintained constant at about 30%, resulting in spark duration and energy that increase inversely with engine rpm. This may result in excessive duration and energy at very low engine rpm. To avoid this, the spark duration can easily be limited to 5.0 ms, as shown, below 1800 rpm. This results in reasonable low-rpm values of duration and energy. The circuitry that accomplishes this limitation is not shown in FIG. 5.

Figure 8:
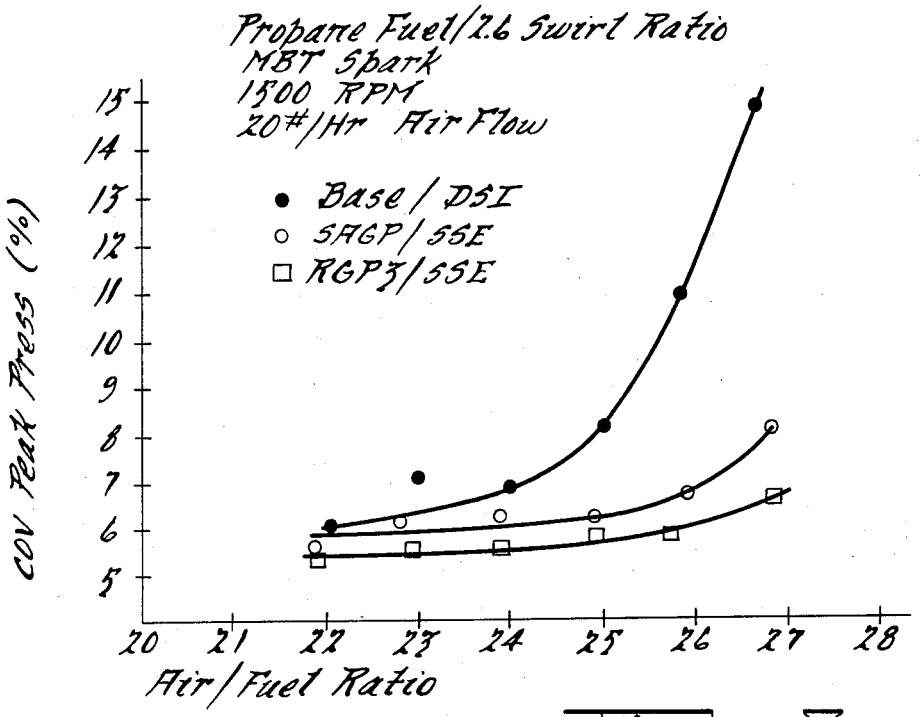
FIG. 8 is a graphical representation of a spark coefficient of variation versus air/fuel ratio for various ignition systems including one in accordance with an embodiment of this invention.

The data of FIG. 8 compare the following ignition system/igniter combinations: (a) distributorless ignition system (DSI) with a base J-type plug; (b) SSE ignition system with a surface air gap plug (SAGP) having three side prongs; and (c) an SSE ignition system with a ring gap plug (RGP) for a spark coefficient of variation (COV) as a function of air/fuel ratio (A/F) at the engine conditions specified, including propane fuel. Although the SSE/SAGP (surface air gap plug) is clearly better than the reference DSI/base plug, the SSE/RGP has a lower COV (less instability) than even SSE/SAGP.

Figure 9:
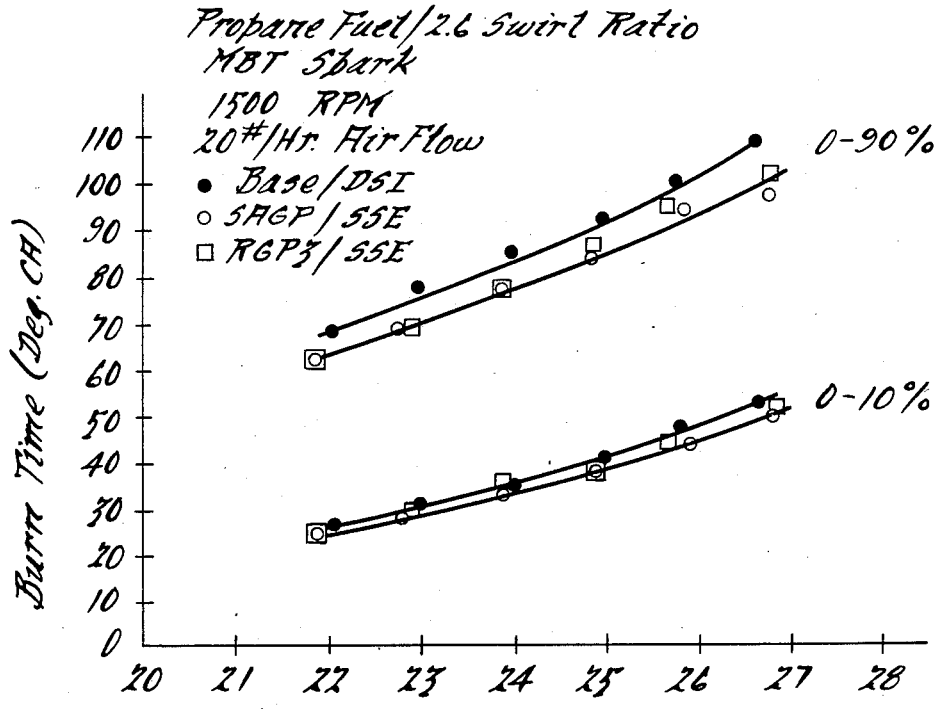
FIG. 9 is a graphical representation of burn time versus air/fuel ratio for various ignition systems including one in accordance with an embodiment of this invention.

FIG. 9 shows a burn time comparison with A/F for DSI/base plug, SSE/SAGP, SSE/RGP is shown. The data indicate both SSE/SAGP and SSE/RGP have comparable 0–10% and 0–90% burn times for the stated engine condition, which, in this case, includes propane fuel.

Figure 10:
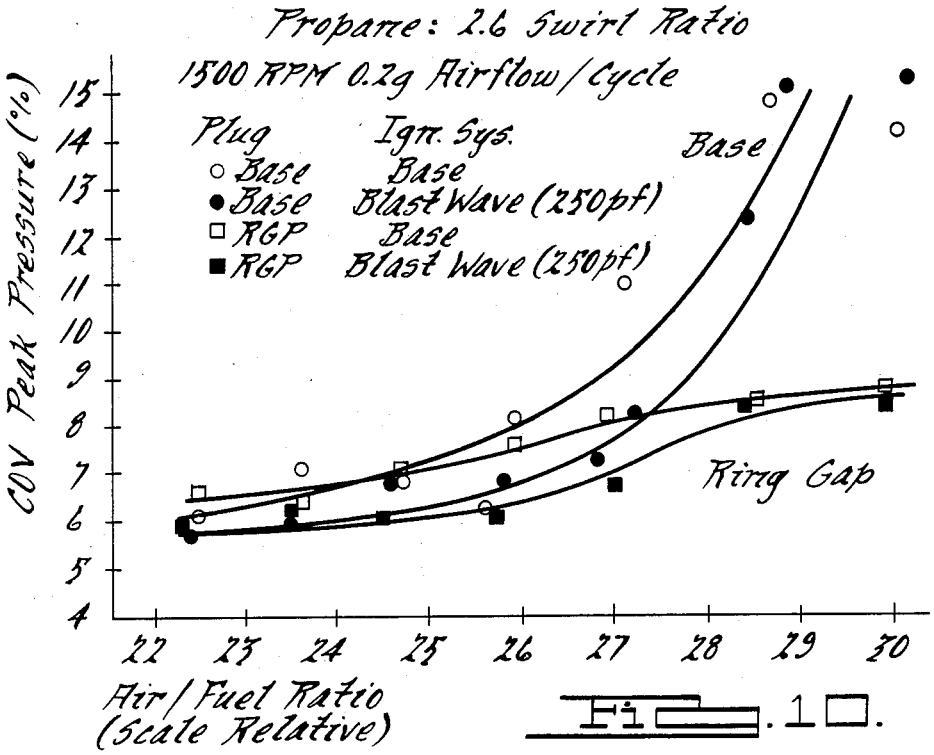
FIG. 10 is a graphical representation of a spark coefficient of variation versus air/fuel ratio for various ignition systems including one in accordance with an embodiment of this invention.

The data of FIG. 10 compare the spark COV vs. A/F for the base DSI ignition system for both the base plug and the RGP with and without the blast wave (added capacitance) ignition system. The data indicate the superiority of the ring gap plug over the base plug either with or without the ignition enhancement provided by the blast wave system.

Figure 11:
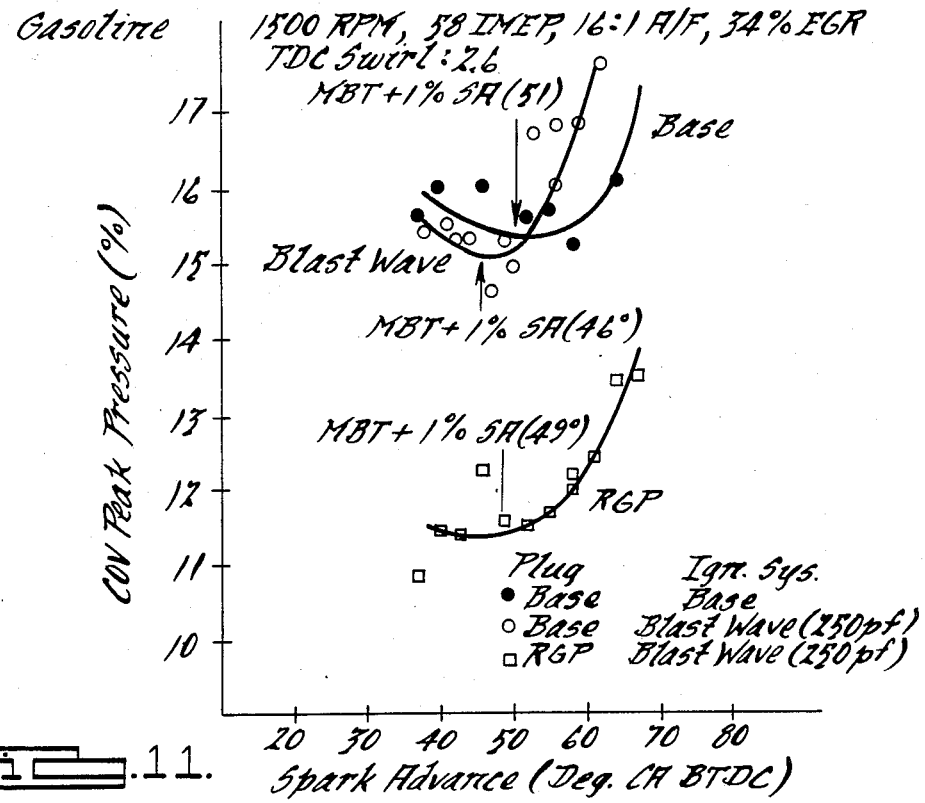
FIG. 11 is a graphical representation of a spark coefficient of variation versus spark advance for various ignition systems including one in accordance with an embodiment of this invention.

FIG. 11 compares the spark COV vs. spark advance characteristics of the blast wave SSE ignition system with a base plug, a base ignition system using DSI with a base plug, and blast wave SSE ignition system with a ring gap plug. The data indicate the combustion stability superiority of the blast wave/RGP ignition system over the other two.

Various modifications and variations will no doubt occur to those skilled in the arts to which this invention pertains. For example, the particular cross-sectional configuration of the ring electrode may be varied from that disclosed herein. Moreover, capacitance can be added to the plug using an external adapter which is part of the plug boot. These and all other variations which basically rely on the teachings through which this disclosure has advanced the art are properly considered within the scope of this invention.

We claim:

1. An ignition system including a spark coupled to a supplemental spark energy circuit, said spark plug having a ring air gap and surface spark path including:

a first electrode having a ring shape defining a central opening:

a second substantially cylindrical electrode positioned coaxially within said central opening of said first electrode;

a symmetrically shaped insulating material positioned between said first and second electrodes so as to provide a surface for a spark path between said first and second electrodes, said insulating material being spaced from said first electrode so as to provide therebetween an air gap;

said spark plug having a substantially symmetrical firing end comprising said first ring electrode, said cylindrical second electrode, and said symmetrically shaped insulating material so that said spark plug (a) has substantially no orientation dependency with respect to the fluid flow direction in a combustion cylinder, and (b) exhibits electrical discharge stability with respect to the in-cylinder fluid flow which is manifested by less elongation and stretching of the electrical discharge path and less subsequent reignition of the original discharge path resulting in improved combustion stability;

said supplemental spark energy circuit including:

an ignition coil having a primary winding and a secondary winding;

an ignition module coupled to said primary winding;

a supplementary spark plug energy module coupled to said secondary winding for providing an electrical output to be applied in combination with the electrical output of said secondary winding to said ring gap spark plug to produce a spark of increased magnitude and duration with increased electrical discharge stability that results in higher spark energy density with the combination of said ring air gap and surface spark path and improved ignitability of dilute combustible mixtures;

a distributor coupled to said secondary winding; and a plurality of spark plugs selectively coupled to said distributor.

2. A spark plug as recited in claim 1 wherein said insulating material is of a ceramic material and extends axially beyond the plane of the ring of said first electrode, and said second electrode extends beyond the axial extent of said ceramic insulating material; and wherein said supplementary spark energy circuit includes:

a power stage for amplifying a voltage;

a control pulse stage for generating a signal for switching on and off components of said power stage;

a spark duration control circuit for generating a signal for controlling the on and off time of said power stage; and an antilatch control circuit for disabling said power stage from said control pulse stage.

3. A spark plug as recited in claim 2 further comprising a capacitance in parallel with said spark path between said first and second electrodes.

4. A spark plug as recited in claim 3, wherein:

said first electrode has a generally circular shape with a generally rectangular cross section.

5. A spark plug as recited in claim 3, wherein:

said first electrode has a generally circular cross section.

6. A spark plug as recited in claim 3, wherein:

said second electrode and said insulating material are adjacent each other and at least portions of which are in contact with each other; and said capacitance having a first plate coupled to said first electrode, a second plate coupled to said second electrode, and a dielectric member, intermediate said first and second plates, having a generally tubular shape extending axially along at least a portion of the length of said spark plug.

7. A spark plug as recited in claim 6, wherein:

said air gap has an extent of about 0.25 to 0.75 mm, said first electrode has an outside diameter of about 8 to 12 mm and an inside diameter of about 4 to 6 mm, and said insulating material having a tracking surface of about 1 to 3 mm between said second electrode and said air gap adapted for supporting a spark path.

* * * * *